US006235150B1

(12) United States Patent
Middleton et al.

(10) Patent No.: US 6,235,150 B1
(45) Date of Patent: May 22, 2001

(54) METHOD FOR PRODUCING PULP AND PAPER WITH CALCIUM CARBONATE FILLER

(75) Inventors: Steven R. Middleton, Pointe Claire; Josée Desmeules, Montreal; Anthony M. Scallan, Pointe Claire, all of (CA)

(73) Assignee: Pulp and Paper Research Institute of Canada, Pointe Claire (CA)

( * ) Notice: Subject to any disclaimer, the term of this patent is extended or adjusted under 35 U.S.C. 154(b) by 0 days.

(21) Appl. No.: 09/271,921

(22) Filed: Mar. 18, 1999

Related U.S. Application Data

(60) Provisional application No. 60/079,097, filed on Mar. 23, 1998.

(51) Int. Cl.[7] ..... D21H 17/67

(52) U.S. Cl. ..... 162/9; 162/164.1; 162/164.6; 162/168.2; 162/168.3; 162/182; 162/183

(58) Field of Search ..... 162/9, 181.2, 182, 162/175, 183, 164.6, 164.1, 168.3, 168.2

(56) References Cited

U.S. PATENT DOCUMENTS 4,510,020 4/1985 Green et al. .
5,096,539 3/1992 Allan .
5,223,090 6/1993 Klungness et al. .
5,275,699 1/1994 Allan .

FOREIGN PATENT DOCUMENTS

WO 98/35095 8/1998 (WO) .

OTHER PUBLICATIONS

The Effects of Lumen–Loading on Strength and Optical Properties of Paper, Miller et al, Journal of Pulp and Paper Science: vol. 11, No. 3, May 1985.
Lumen Loading of Bleached Pulps, Middleton et al, Journal of Pulp and Paper Science 15(6): J229–235 Nov. 1989.
Lumen Loading with Calcium Carbonate Pigments, Chang et al, Institute of Paper & Graphic Arts, Chinese Culture University.
English Language Translation of Japan TAPPI, vol. 43, No. 5, pp. 495–506.

*Primary Examiner*—Peter Chin
(74) *Attorney, Agent, or Firm*—Swabey Ogilvy Renault

(57) ABSTRACT

A method is described for attaining high levels of loading of calcium carbonate fillers in the lumens of wood pulp fibers. The pulp is pretreated with a cationic polymer prior to being impregnated with the filler. Different conditions of pH and temperature are specified depending on whether the filler is a precipitated calcium carbonate or a ground calcium carbonate. The lumen-loaded pulps are used to make novel products with advantages in higher filler retention and sheet strength over conventionally made papers.

26 Claims, 7 Drawing Sheets

METHOD FOR PRODUCING PULP AND PAPER WITH CALCIUM CARBONATE FILLER

This application claims benefit of Provisional application No. 60/079,097, filed Mar. 23, 1998.

BACKGROUND OF THE INVENTION

1. Field of the Invention

This invention relates to an improved method for the production of pulps of high filler content in which filler is loaded in the lumens of the cellulose fibres and to novel pulps produced using such method.

More specifically, the present invention relates to a novel method of producing paper containing high concentrations of calcium carbonate filler and to novel paper produced by the method.

2. Description of the Prior Art

The increasing use of calcium carbonate as a filler in fine papers has been a major trend in recent years. The resultant alkaline sheets are brighter, stronger, have superior printability and are more permanent than sheets made under acidic conditions. In addition, the use of calcium carbonate is a means of reducing the furnish costs by substituting fibre with less expensive filler. With these incentives, many papermakers strive to raise the filler content as high as possible. However, as filler content is increased, paper strength is reduced resulting in poor papermachine runnability. Fillers contribute nothing to paper strength themselves and lower the concentration of load-bearing fibres. In addition, filler particles accumulate on exterior fibre surfaces reducing paper strength by interfering with inter-fibre bonding.

Green, Fox and Scallan (U.S. Pat. No. 4,510,020) describe one approach to improving the strength of papers containing fillers. They disclose a method of loading the filler within the fibre lumens where it does not interfere with fibre—fibre bonding. Thus, the potential is there for greater filler contents in the paper and better paper machine runnability. The basic process of lumen loading involves an impregnation step in which the pulp is agitated in a concentrated suspension of filler to allow the filler particles to enter the lumens via pit apertures. If attractive forces between the filler particles and the fibre surfaces exist, the filler bonds to both exterior and the lumen surfaces of the fibres. In a subsequent step the particles on the exterior surfaces of the fibres are removed by washing the pulp. For the most part, the disclosure is focused on the use of titanium dioxide fillers which proved to be very suitable for lumen loading.

Application of the lumen-loading principle to calcium carbonate fillers was mentioned as possible in U.S. Pat. No. 4,510,020 but no examples were given. Okayama et al. Japan Tappi, 43(5), 495, (1989) found that calcium carbonate, in the size range of commercial fillers, generally loaded to levels of less than 0.08 g/g of fibre; a much lower loading level than titanium dioxide under comparable conditions. A value of 0.15 g/g was obtained on a calcium carbonate of 0.1 $\mu$m diameter—well below the size of commercially available fillers of practical and economic importance in papermaking.

Retention aids have been proposed to promote lumen loading of fillers. Middleton and Scallan, J. Pulp Paper Sci., 15(6), 229 (1989) have described the use of a cationic polyacrylamide at pH 4 to increase lumen loading using titanium dioxide. Miller and Paliwal, J. Pulp Paper Sci., 11(3), 84, (1985) have described the use of polyethylenimine to increase the levels of lumen loading using titanium dioxide and clay fillers. A process for lumen loading calcium carbonate using polyethyleneimine is described by Chang et al, Taga Proceedings 1997 (TAGA), Session: Experimental Analysis of Printing, p639–657, 1997. Using a precipitated calcium carbonate, Chang et al reported loading levels of only 1–5% with a brief mention of a maximum level of 10.8% being achieved using 8% polymer addition and mixing being carried out at a pH of 13. These conditions of a very high polymer addition and a very high pH would be a severe barrier to practical implementation in a mill. Another method for lumen loading calcium carbonate is reported by Hockman and Sohara, International Publication Number WO 98/35095. In this method filler and fibre are mixed together so as to effect lumen-loading. This is followed by the addition of a flocculating agent to prevent the filler diffusing outside the lumens. Levels of loading of up to 10% were claimed.

There have been other approaches to producing pulps containing calcium carbonate formed by "in situ" precipitation. Allan et al. U.S. Pat. Nos. 5,096,539 and 5,275,699, for example, saturate fibres with calcium chloride solution and then add sodium carbonate solution. However, in addition to producing calcium carbonate, the process leaves sodium chloride as a by-product which is considered detrimental in any commercial application. In an attempt to avoid such a by-product, Klungness et al. U.S. Pat. No. 5,223,090 impregnate fibres with calcium hydroxide solution and then apply an atmosphere of carbon dioxide to precipitate calcium carbonate. Both precipitation procedures produce calcium carbonate in various locations in a pulp. Klungness et al reported that the filler actually in the lumen was less than 0.06 g filler/g fibre.

For both "in situ" precipitation techniques, the claims in terms of benefits for the paper sheet are similar to those of lumen loading. These benefits are improved retention of filler during sheet formation and superior sheet strength over conventionally-filled sheets, i.e., where all the filler is retained on the outer surfaces of the fibres. The two precipitation techniques have common disadvantages. The first is the difficulty of obtaining an optimum size distribution of the filler for maximum optical properties. In contrast, commercial precipitated calcium carbonate is manufactured to specific particle sizes to produce optimum light-scattering characteristics. The second is that much filler is not within the lumen but external to the fibre i.e., where it causes a loss of sheet strength. In addition, "in-situ" procedures call for marked deviations from common papermaking practices.

At present, two classes of calcium carbonate fillers are commercially available. The first is a "ground" filler prepared by mechanically grinding naturally occurring deposits such as chalk or limestone. The other class is a "precipitated" filler prepared from a solution by addition of a reactant bringing about a precipitation of calcium carbonate. Within the two classes there are various grades based on particle size and shape. However, a chemical difference between the two is that the "ground" filler usually contains an adsorbed dispersant rendering its particles with a negative electrical charge while the "precipitated" filler usually has no such additive and its particles retain their natural weakly positive charge. Although the terms ground and precipitated are used in this specification it is the aspect of the electrical charge of the filler particles to which we are referring rather than the method of preparation of the filler.

SUMMARY OF THE INVENTION

It is an object of this invention to provide a process for production of pulp fibres, lumen-loaded with a calcium carbonate particulate filler.

It is another object of this invention to provide pulp fibres lumen-loaded with a calcium carbonate particulate filler.

In one aspect of the invention there is provided a process for production of pulp fibres, lumen-loaded with a calcium carbonate particulate filler comprising: a) contacting pulp fibres having anionically charged lumen surfaces, with an aqueous solution of a cationic polymer with formation of ionically charged polymer bound to the lumen surfaces, and b) contacting the resultant pulp fibres with particulate calcium carbonate filler having an ionic charge and binding the particulate calcium carbonate filler to the lumen surfaces, such that the ionic charge on the filler is opposite to an ionic charge on the bound polymer.

In another aspect of the invention there is provided a process for the production of pulp fibres, lumen-loaded with a calcium carbonate particulate filler comprising: i) agitating a suspension of pulp fibres with a water soluble cationic polymer to form a suspension in which the pulp fibres have the polymer bound to the lumen surfaces of the fibres, and ii) adding a calcium carbonate particulate filler to the resulting suspension from step i) and agitating so as to impregnate the lumens of the pulp fibres with the filler.

In yet another aspect of the invention there is provided pulp fibres lumen loaded with calcium carbonate filler and having ionically charged water soluble polymer bound to the lumen surface of the fibres.

DESCRIPTION OF PREFERRED EMBODIMENTS WITH REFERENCE TO THE DRAWINGS

Figure 1:
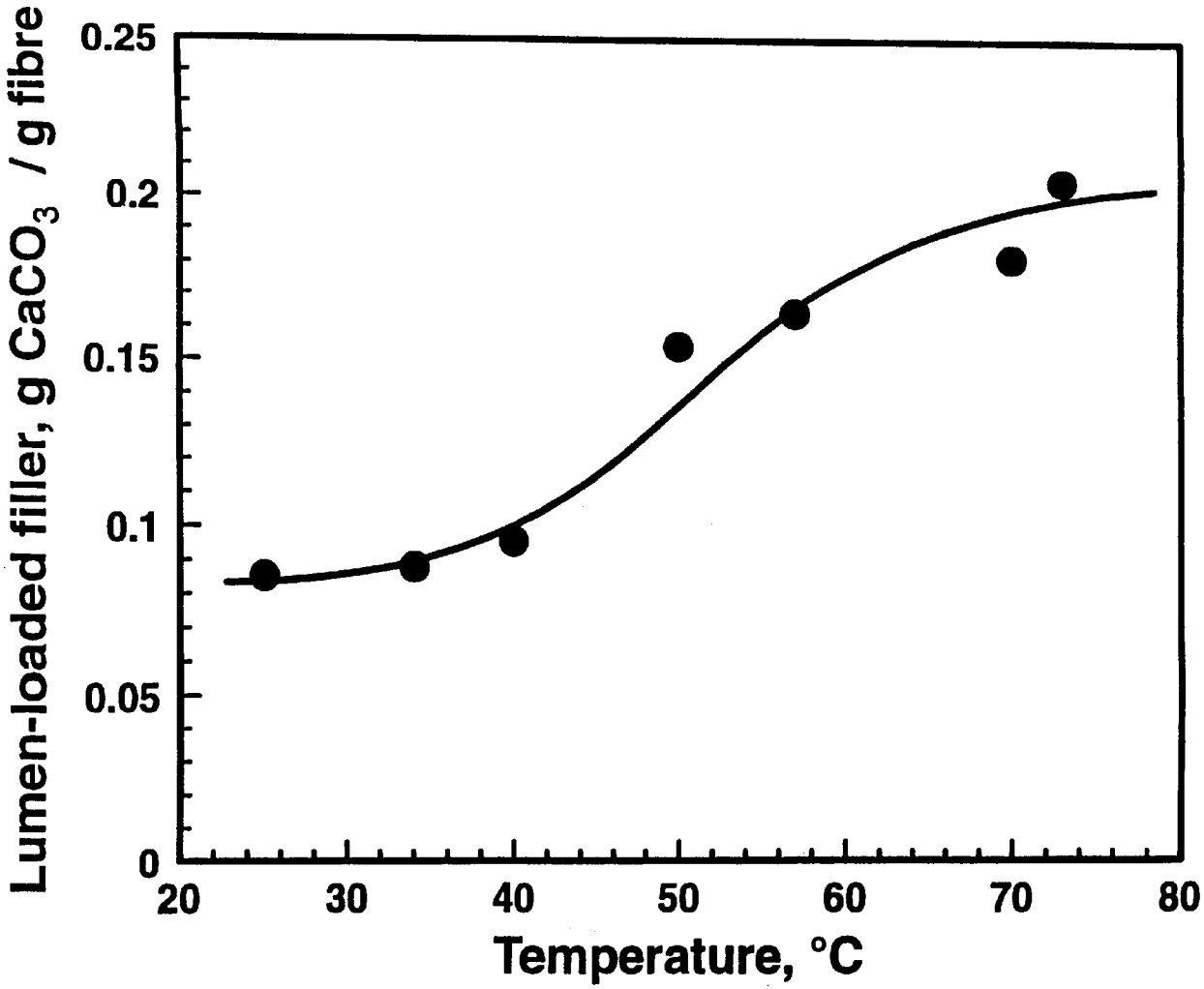
FIG. 1 illustrates graphically the relationship between lumen-loading level achieved and temperature, employing cationic filler and hydrolysable polymer in a process of the invention.

In the first step of a particular embodiment of the method of the invention, a cationic polymer acts as a polymeric retention aid and is added to a pulp fibre suspension while agitating the suspension for a period of time sufficient to cause the retention aid to enter the lumens of the fibres; suitably the polymer enters the lumens of the fibres in an amount of 0.01% to 1.0%, by weight, based on the oven dry weight of the pulp fibres in the suspension. In the second step, a slurry of calcium carbonate filler is added to the polymer treated fibre suspension and agitation is continued for a period of time sufficient to cause the filler to enter the lumens of the fibres, become attached to the lumen wall, and to achieve sufficient loading of filler in the lumens. In an optional third step any filler attached to the external walls of the fibres may, if required, be partially or totally removed by washing the suspension.

The calcium carbonate filler is, in particular, ground calcium carbonate filler having a negative charge, i.e., anionic, or precipitated calcium carbonate filler having a positive charge, i.e., cationic.

The fillers typically have a particle size of 0.4 to 1.5 $\mu$m.

Lumen-loadings are achieved in the order of 0.1 to 0.4 g $CaCO_3$/g of fibre, or 9 to 28%, by weight, of filler, based on the weight of lumen-loaded-fibres, i.e., the combined weight of the fibres, adsorbed polymer and filler in the lumen.

The polymer employed in the invention is a water soluble, cationic polymer of the type used as a retention aid to retain fillers in paper manufacture, and is employed in an aqueous solution.

The polymer is preferably a polyacrylamide containing quaternary ammonium groups attached by ester linkages to the polymer backbone and is more preferably of high molecular weight ($10^5$ to $10^7$) and low charge density. The ester linkages are hydrolysable and thus this polymer is especially advantageous when the calcium carbonate filler has a cationic charge, for example, precipitated calcium carbonate filler.

The polymer is also useful with calcium carbonate filler having an anionic charge, for example, ground calcium carbonate.

Other cationic polymers, for example, polyethylenimines, polyamines, polyamides and polydiallyldimethyl ammonium chloride, as well as cationic starch may also be used when the calcium carbonate filler has an anionic charge, for example, ground calcium carbonate filler. These cationic polymers do not hydrolyse to anionic polymers and thus are less useful with cationic calcium carbonate fillers such as precipitated calcium carbonate.

In a particular embodiment of this invention, to obtain maximum lumen loading of precipitated calcium carbonate filler, the polymer is, with advantage, a hydrolysable cationic polyacrylamide and the impregnation step of the process is conducted at a temperature greater than 40° C.

In yet another embodiment of the invention adapted to using ground calcium carbonates, the same process is employed but the temperature during impregnation is kept below 40° C. Alternatively a "non-hydrolysable" cationic polymer is used.

In a product embodiment of this invention, a pulp, the lumens of which have been loaded with calcium carbonate according to the invention, is used as part of a papermaking furnish to produce a paper which is stronger at a given filler content than a paper with all the filler conventionally-loaded onto external fibre surfaces.

The fibres most widely used in papermaking are cellulosic fibres derived from wood and after pulping the majority appear, under the microscope, as long hollow tubes, uniform in size for most of their length but tapered and closed at each end. Along the length of the fibre, the fibre wall is perforated by small apertures or pits which connect the central cavity or lumen to the fibre exterior. One criterion for the employment of a filler in a lumen loading process is that the filler particles are of such a size that they can enter the lumens via accessible openings, i.e., the pits or cut ends of fibres. Most commercially available calcium carbonate fillers have a particle size suitable for lumen loading.

A further requirement in obtaining an appreciable level of lumen loading is that there be a strong attractive force to hold the filler particle to the lumen wall. In the absence of such a force there will be no significant build-up of filler in the lumen and any small accumulation will be removed in subsequent washing or processing steps.

The lumen surface, like the exterior surface of the fibres, has a natural anionic charge due to the presence of carboxylic, and, on occasion, sulphonic acid groups within the fibre wall material. This means that ground calcium carbonates, which contain anionic dispersants conferring a negative charge to the particles, will not lumen load significantly due to the repulsive force between the like charges of filler and fibre surfaces. However, precipitated calcium carbonate, which has a small cationic surface charge will be retained by the fibres to some degree due to the small attractive force between the cationic filler and the anionically-charged lumen-surface. Nevertheless, even with precipitated calcium carbonate, the level of lumen-loading is still too low to be practically useful.

In the process of the invention, to achieve high levels of lumen loading with calcium carbonate in excess of 9%, by weight, pulp fibres dispersed in water as a suspension, are first treated with a cationic polymer and agitation is employed to cause the polymer to be adsorbed on the exterior and lumen surfaces of the pulp fibres. Five minutes of agitation is found to be sufficient. Due to its cationic charge, the polymer readily adsorbs onto the anionic fibre surfaces. Following the polymer addition, precipitated calcium carbonate filler, pre-dispersed as a suspension in water usually at 20% solids, is added and the fibres are impregnated with filler using vigorous agitation. During impregnation, the filler enters the lumens and attractive colloidal forces, induced by the polymer, hold the filler particles onto the lumen wall. Following completion of the impregnation step a significant fraction of the filler remains free in suspension and on the external walls of the fibres. Optionally, the fibres can be made substantially free of external filler by washing the pulp while containing it by a screen which will permit passage of filler particles but not the fibres. Sufficient shear is introduced during the washing action to overcome the attractive colloidal forces holding the filler particles to the external surface but not to unduly dislodge particles in the lumens. The particles in the lumen are protected to some extent from the shear forces by the fibre wall although some loss of this filler will occur. For this reason, it is preferable not to prolong washing beyond the time necessary to remove the external filler on the fibres.

In a further embodiment of the invention applied to achieving high levels of lumen-loading of precipitated calcium carbonate fillers, the polymer of choice is a cationic polyacrylamide polymer such as Percol 292 (Trade-mark of Allied Colloids Inc.). Preferably, the polymer pretreatment is carried out with the fibre suspension below pH 7 and the impregnation step is carried out at an elevated temperature, preferably greater than 40° C. and at a pH greater than 8. The alkaline pH value is achieved naturally by the addition of the calcium carbonate. A graphical illustration showing the preferred embodiment of elevated temperature to achieve high loading levels when using precipitated calcium carbonate is shown in FIG. 1. These surprising results are believed to be due to the effect of pH and temperature on the cationic polyacrylamide. The cationicity of the polymer arises from quaternary ammonium groups attached by ester linkages to the polymer backbone. Under conditions of alkalinity and accelerated by heat, hydrolysis of the ester linkages occurs, the polymer loses its cationic charge and gains an anionic charge arising from the acid groups formed on the polymer as residuals of the ester linkages. Thus the initial cationicity of the polymer achieves adsorption of the polymer onto the negatively charged fibre lumen surfaces. When the precipitated calcium carbonate is added to start impregnation, the pH of the suspension naturally becomes alkaline and if the suspension is heated to 40° C. or more, hydrolysis occurs. However, in spite of the charge reversal, the polymer still remains attached to the fibre lumen wall and the anionic charge produced on the polymer favours attachment of the cationic precipitated calcium carbonate.

Figure 2:
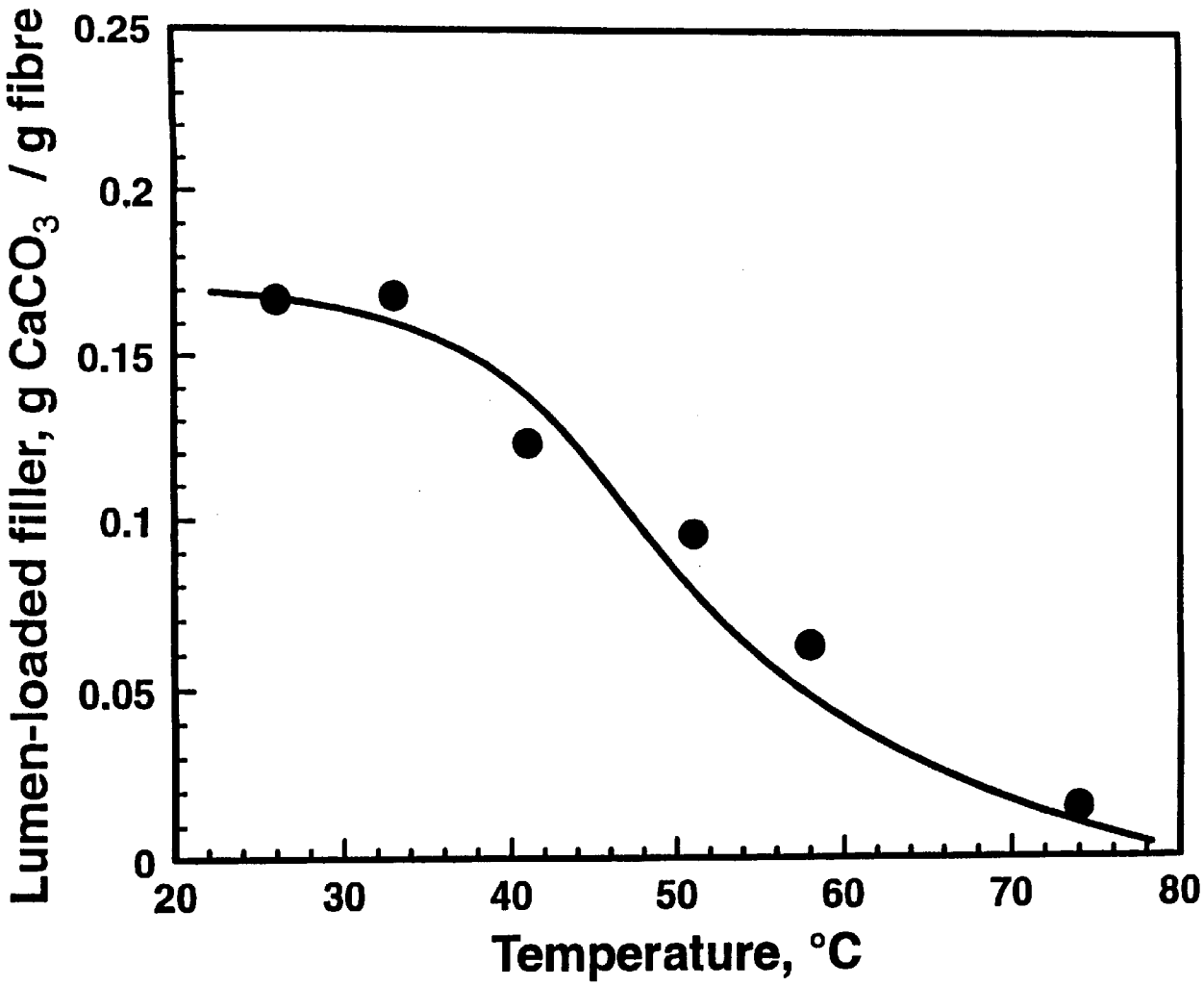
FIG. 2 illustrates graphically the relationship between lumen-loading level achieved and temperature employing anionic filler and hydrolysable polymer, in a process of the invention.

It has been found that, when ground calcium carbonate is lumen loaded using the same polymer and the same physical conditions as for the preceding experiments, higher impregnation temperatures are detrimental. This is probably because hydrolysis of the polymer leaves both fibre surface and filler negatively charged. A further embodiment of the invention for anionic fillers coupled with hydrolysable polymers, is that a high loading level is favoured by operating the impregnation step at temperatures less than 40° C. as illustrated in FIG. 2 so as to avoid hydrolysis and maintain the cationic charge on the polymer. Alternatively, in yet a further embodiment using ground calcium carbonate filler, a non-hydrolysable cationic polymer can be employed and then the impregnation temperature is immaterial. As indicated above the polymer can be chosen from a large group of cationic polymers currently used in papermaking furnishes, including cationic starch, polyethylenimine, poly-DADMAC (polydiallyldimethyl ammonium chloride), polyamine and polyamide.

Figure 3:
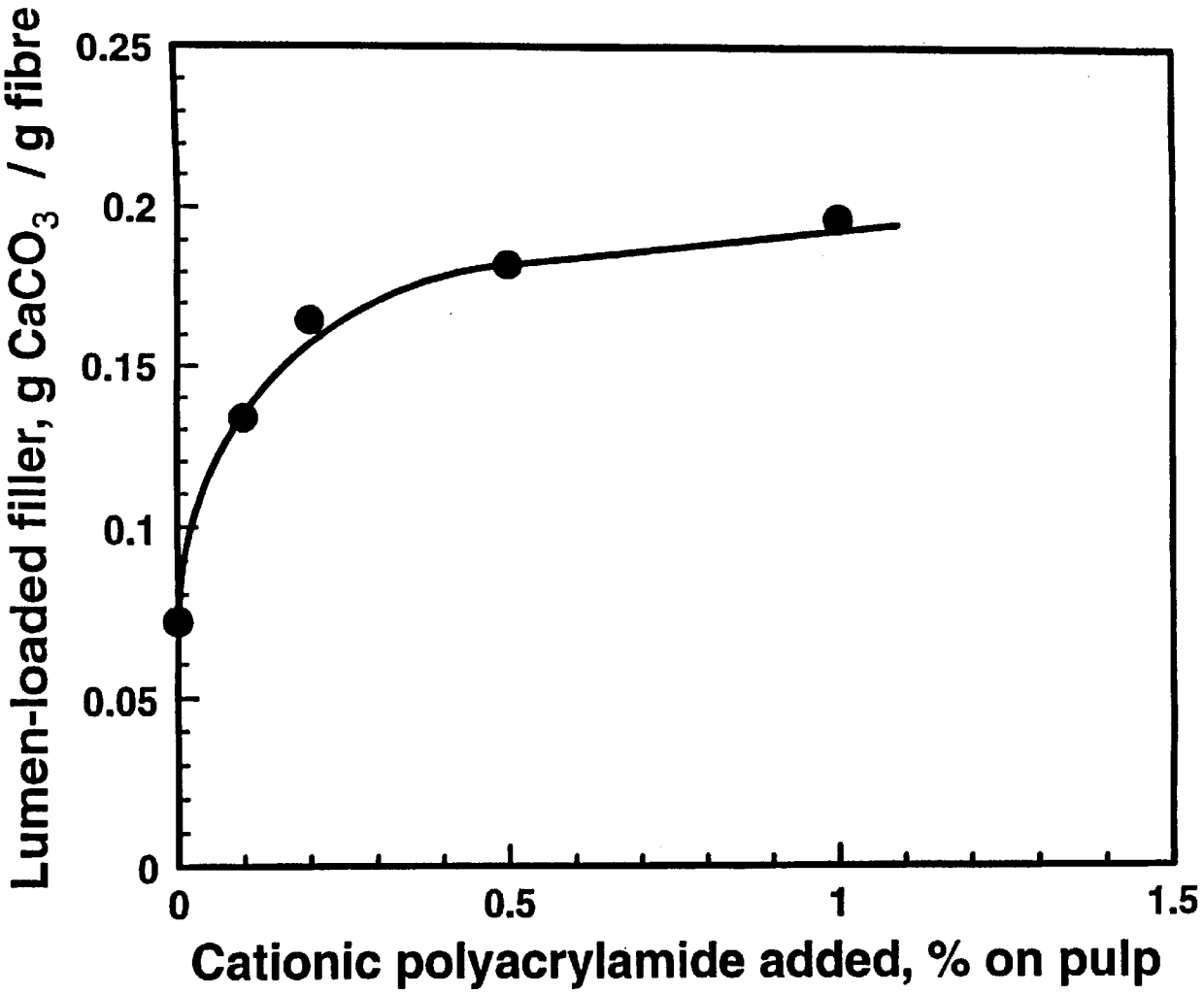
FIG. 3 illustrates graphically the relationship between lumen-loading level and amount of polymer added.

The foregoing features of the invention have been disclosed to show when and how certain calcium carbonate fillers can be appreciably loaded or not and these are the primary features of the invention. Additionally, several other variables affecting the actual level of loading have been discovered. The effect of the level of addition of polymer is illustrated in FIG. 3. An addition of 0.05% of Percol 292 (Trade-mark) is indicated as producing an observable effect but a 0.5% addition is preferred.

Figure 4:
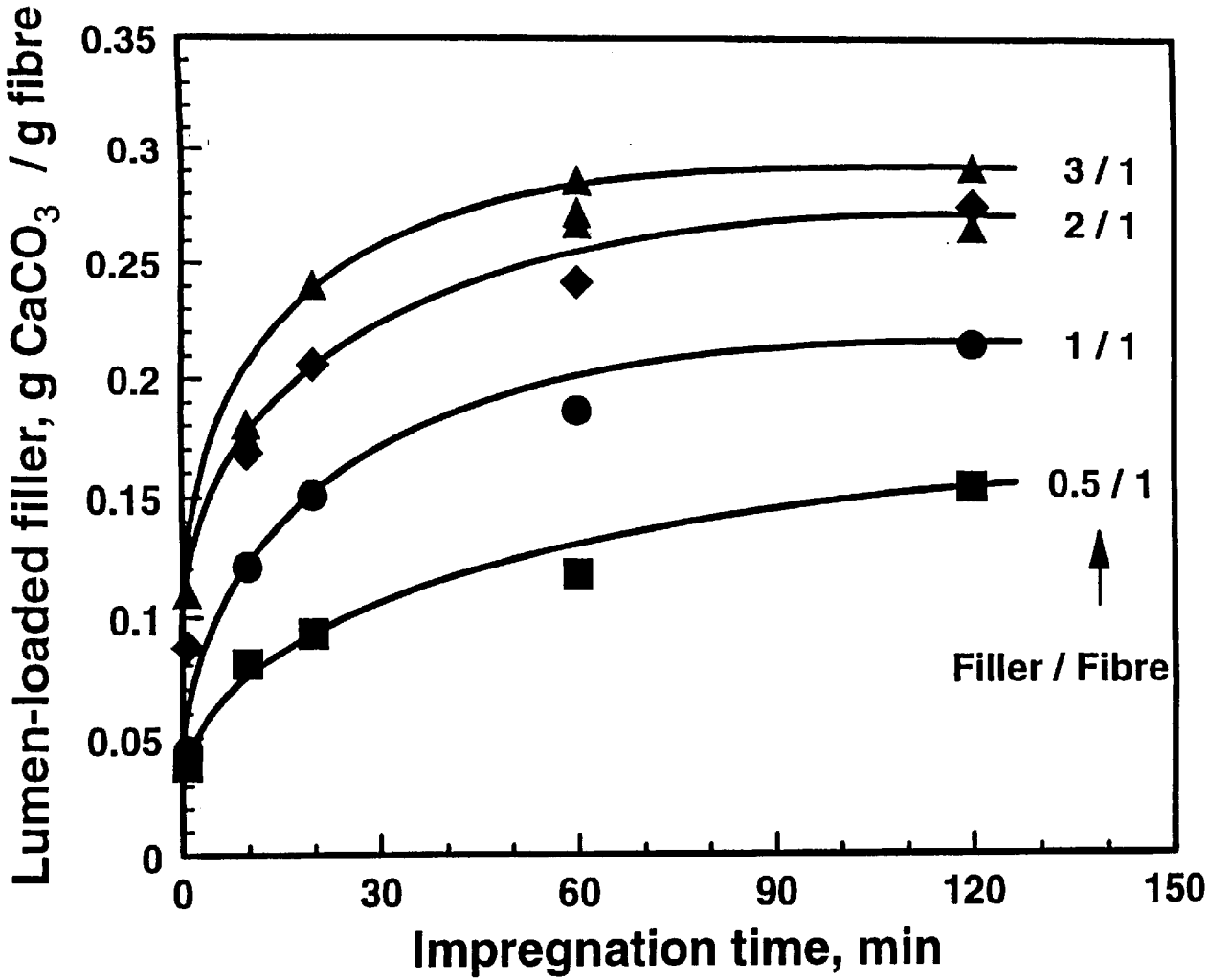
FIG. 4 illustrates graphically the relationship between level of lumen-loading and time at different filler/fibre ratios.

The effect of time of impregnation is illustrated in FIG. 4. While appreciable loading is achieved in 20 mins, 60–120 mins is preferred in order to effect maximum loading. FIG. 4 also illustrates that the higher the filler to fibre ratio, the higher the level of lumen loading. Very high ratios are not too practical to achieve high loading and in general a weight ratio of filler to fiber of 0.5:1 to 3:1 is employed in the process.

Figure 5:
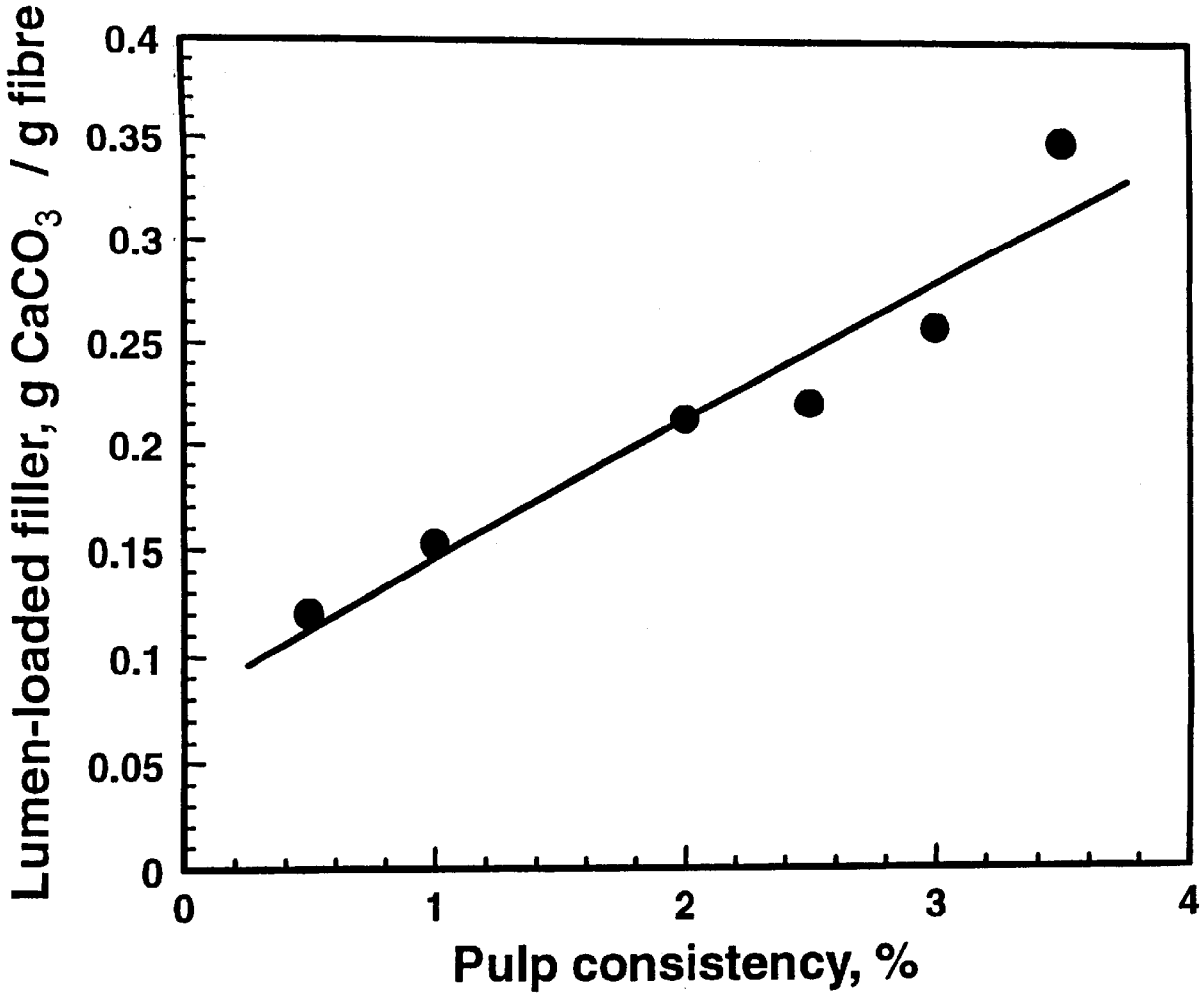
FIG. 5 illustrates graphically the relationship between lumen-loading level and pulp consistency.

The results in FIG. 5 illustrate how, at a low filler to fibre ratio, loading may be greatly increased by employing higher pulp consistencies. It is believed that the reason for this phenomenon is that the driving force for loading is the concentration of filler in suspension rather than the filler to fibre ratio per se. From these findings it will now be clear to a person skilled in chemical kinetics how one may obtain optimum performance with the combinations of novel variables at his disposal.

Experimentation has been on a laboratory scale using thirty grams of pulp per run, but the preferred procedure has also been demonstrated for precipitated calcium carbonate carried out in a pilot plant handling 27 kg of pulp per run. Notably the procedure is translatable to the larger scale without change in kinetics, thus the time scale of impregnation is the same. Four separate runs with the same set of conditions showed the procedure to be highly reproducible. An inclined screen device was shown to be a practical means for washing on a large scale.

Figure 7:
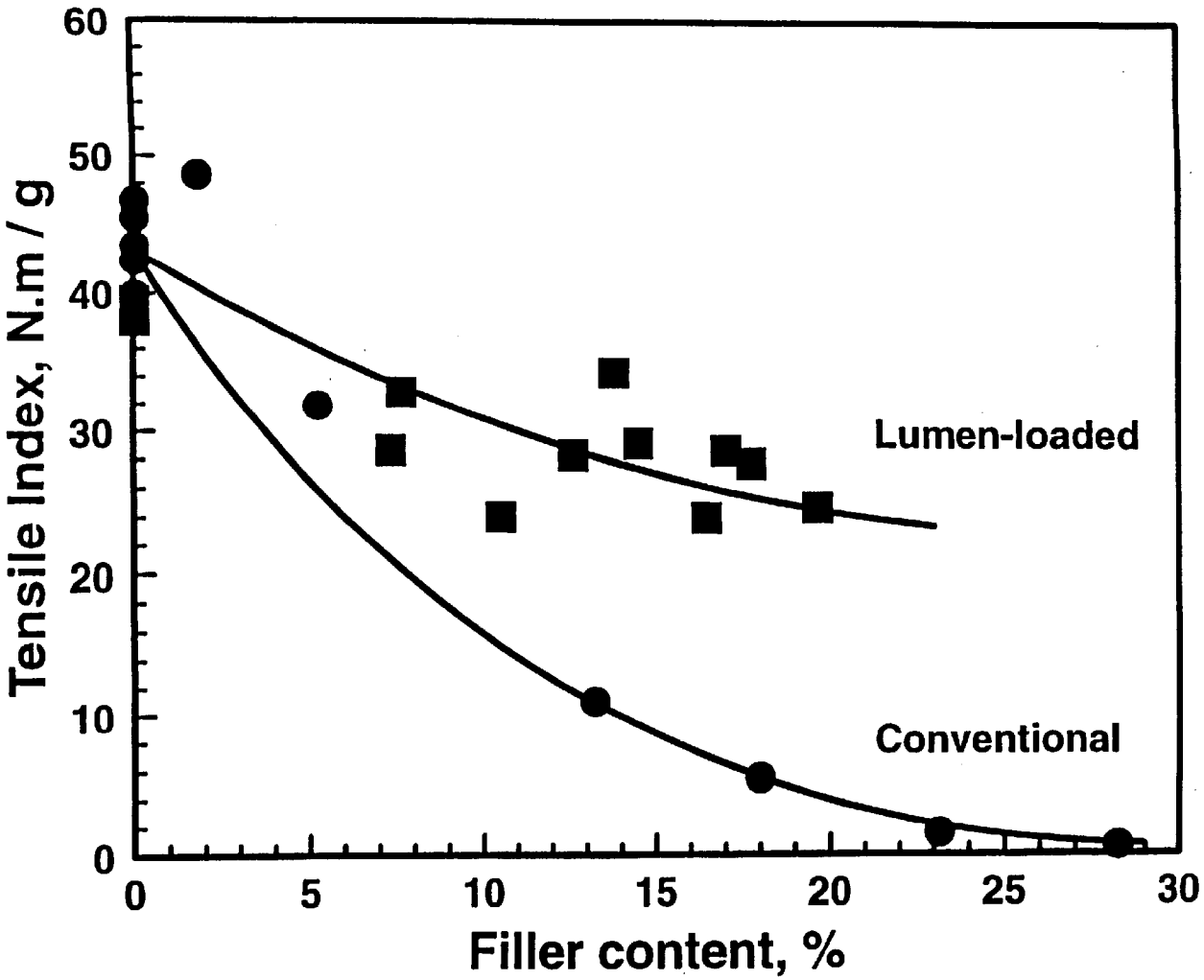
FIG. 7 illustrates graphically a comparison between strength properties of paper sheets formed from pulps of the invention, and paper sheets conventionally filed with cation carbonate filler.

As to the use of lumen-loaded pulp made according to the novel process of the invention, the washed product can be used as part of a furnish containing other pulps, additives and fillers. The advantage of adding lumen-loaded pulp as a component to the furnish is that the filler contained within the fibre will have less of a weakening effect on the sheet than externally held filler as shown in FIG. 7. This aspect may be utilized to increase the filler content of the paper sheet or alternatively to obtain a stronger and better running sheet at the same filler content.

In an alternative application of the lumen-loaded pulp, the loaded pulp after the impregnation step is not washed free of the unloaded filler but mixed directly with other stock in the papermaking furnish. One example would be a fine paper mill using a softwood/hardwood furnish and producing a sheet containing calcium carbonate. In such an application it would be advantageous to use all the filler intended for the final sheet, in a lumen loading treatment of the softwood fibres thus confining treatment to the most responsive pulp and obtaining the high filler to fibre ratio necessary for high loading. Following loading and without washing, the hardwood pulp could then be added to the furnish. Although the final sheet will contain a large fraction of filler conventionally-loaded, a significant fraction of the loading will be in the lumen bringing some benefits in terms of retention, sheet strength and hence runnability. These factors will permit a higher level of filler in the sheet and hence a reduction in furnish cost.

Pulp fibres lumen-loaded with calcium carbonate made according to this invention can be used in a wide variety of applications including fine papers, light-weight newsprint, newsprint specialities etc. Without further elaboration, it is believed that one skilled in the art can, using the preceding description, utilize the present invention to its fullest extent. The following are further illustrations of the novel findings and should not limit the scope of this invention in any way.

EXAMPLES

Example 1

30 g dry weight of a bleached never-dried softwood kraft pulp was diluted to 1000 g with deionised water and dispersed in a mixing device (British disintegrator) for 5 mins at 3000 rpm. To this suspension, a cationic polyacrylamide (Percol 292 from Allied Colloids Inc.) was added to give 0.5% by weight on pulp. The polymer was added as a 1 g/L solution previously prepared from dry polymer by gentle stirring in deionised water for 24 hours. Adsorption onto the pulp was allowed to occur during 10 min stirring at 1000 rpm. Then, 90 g (dry weight) of a precipitated calcium carbonate filler (Albafil M Trade-mark of Specialty Minerals Inc.), predispersed in water at 20% concentration, was added to the pulp. Finally, sufficient water was added to raise the total weight of water in the British disintegrator to 1500 g. The mixture was then stirred for 1 hour at 1000 rpm at a temperature of 75° C. to effect loading.

Following the impregnation, the fibre/filler mixture was washed in tap water (8 L/min) in a single unit of a Bauer-McNett classifier (equipped with a 100 mesh screen) until the fibre was free of external filler (10 min). The filler content within the lumens was calculated from the ash content of the pulp determined at 900° C. and was found to be 0.28 g filler/g fibre.

Example 2

The same procedure to that described in Example 1 was repeated but with the impregnation step carried out at a series of temperatures between 25 and 75° C. The ratio of filler to fibre was 2:1 and the impregnation time was 20 minutes, otherwise conditions were as for Example 1. FIG. 1 shows the results of these experiments and illustrates the beneficial effect of temperature in the case of precipitated calcium carbonate filler.

Example 3

The procedure given in Example 1 was carried out on a series of different pulp fibres. As shown in Table 1, all the pulps respond to the lumen-loading treatment but there is a variation in loading level due to the nature of the fibres.

TABLE 1

Calcium carbonate loading (g filler/g fiber) as a function of pulp type.

| | |
|---|---|
| Bleached kraft, softwood, never dried, unbeaten | 0.28 |
| Bleached kraft, softwood, never dried, beaten | 0.27 |
| Bleached kraft, softwood, dry-lap, rewetted | 0.17 |
| Unbleached kraft, softwood, never dried | 0.27 |
| Thermomechanical, softwood | 0.23 |

Example 4

The procedure given in Example 1 was carried out on a scalenohedral type of precipitated calcium carbonate of particle size 1.3 $\mu$m. The loading level was 0.14 g filler/g fibre compared to that of 0.28 g/g for the smaller filler (size 0.8 $\mu$m) cited in Example 1.

Example 5

The procedure given in Example 2 was repeated using a ground calcium carbonate as filler (Omyafil from Omya Inc.). The level of lumen-loading was 0.17 g filler/g fibre at 25° C. falling to 0.02 g filler/g fibre at 75° C. This result is given in FIG. 2 showing a preferred embodiment of an impregnation temperature less than 50° C. when a hydrolysable polymer and a ground calcium carbonate are used. An impregnation temperature of less than 40° C. is yet more preferable in improving the level of lumen loading.

Example 6

The procedure given in Example 1 was carried out with a 2:1 ratio of filler to fibre, an impregnation time of 20 minutes, and a series of different polymer addition levels. FIG. 3 illustrates the effect of polymer addition on the level of lumen-loading showing a preferred embodiment of a cationic polyacrylamide polymer addition of at least 0.1% on pulp.

Example 7

The procedure given in Example 1 was carried out a number of times and variations were made in impregnation time and the filler to fibre ratio. Increases in both these parameters result in higher levels of lumen loading as illustrated in FIG. 4. Thus, preferred embodiments to achieve high levels of lumen loading, are the use of high filler to fibre ratios and, at any given filler to fibre ratio, extending the time of impregnation until a maximum in loading is obtained.

Example 8

A series of lumen-loading procedures were carried out at various pulp consistencies following the procedure given in Example 1 except that the filler to fibre ratio was held at 1:1 and the mixing speed during impregnation was 2000 rpm. The results of these experiments are given in FIG. 5 and illustrate that, to achieve high levels of lumen loading at any given filler to fibre ratio and impregnation time, a preferred embodiment is the use of as high a pulp consistency as possible in the impregnation stage.

Example 9

A pilot plant for producing lumen-loading pulp was assembled and four runs were made. A never-dried bleached kraft pulp made from softwoods was used for these runs. The polymer was a cationic polyacrylamide (Percol 292, Allied Colloids Inc.) and, prior to each run, 200 g of dry polymer was gently stirred in 200 L of deionized water for 16 hrs at 25° C. The filler was a dry precipitated calcium carbonate (Albafil M, Specialty Minerals Inc.) and, prior to each run, 54 kg was dispersed in 162 kg tap water using a Cowles mixer.

To start a run, 27 kg of the pulp with associated water (total weight 163 kg) was added to 700 L tap water at 96° C. in a baffled tank of capacity 3000 L. The pulp was stirred at 300 rpm with a 4-blade rotor for 5 minutes to achieve good dispersion. The polymer solution was then added to the pulp (0.75% polymer on pulp) and mixing carried out for 10 min at 300 rpm and a temperature of 80° C.

Figure 6:
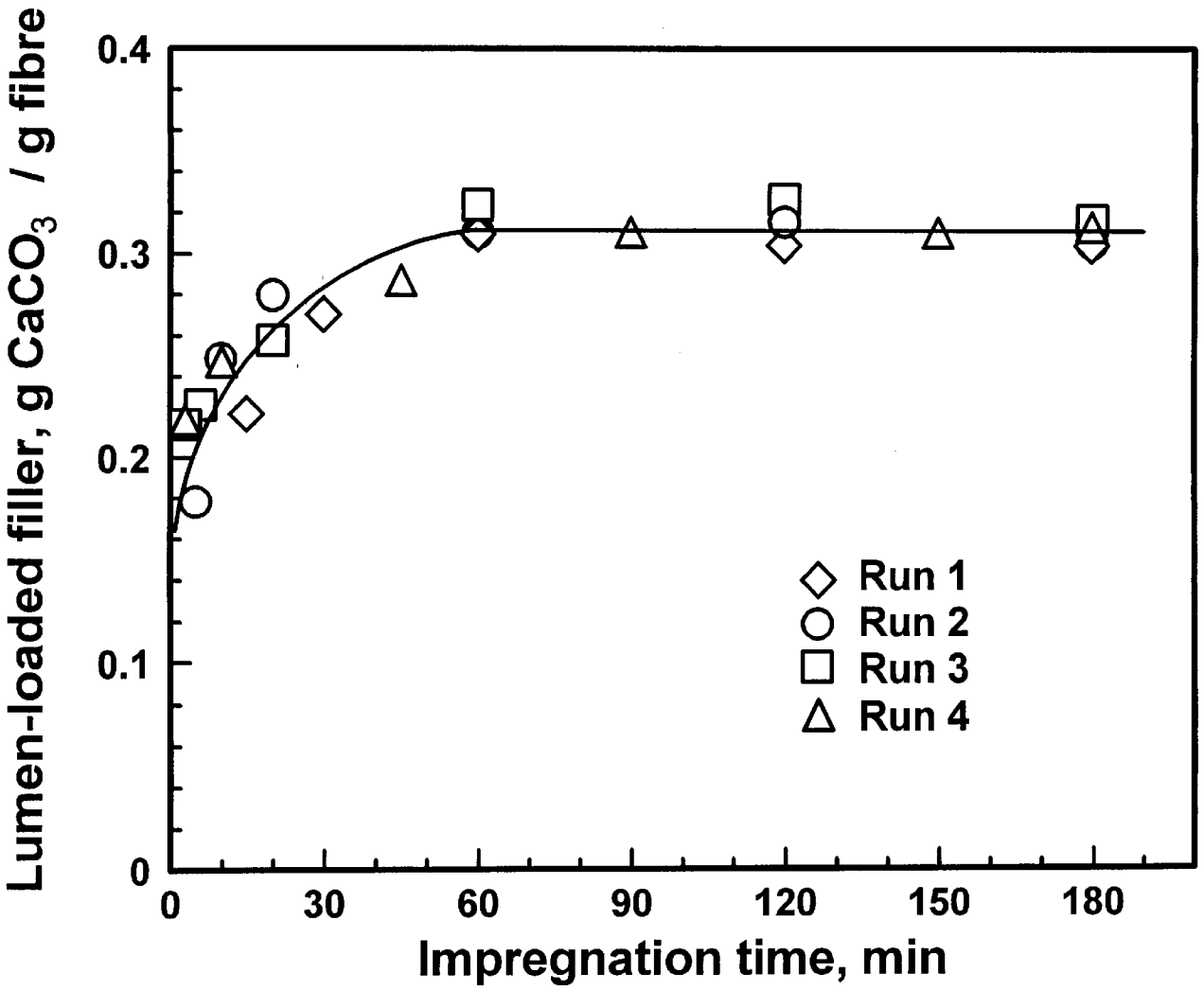
FIG. 6 illustrates graphically the relationship between lumen-loading level and impregnation time for different pilot plant runs.

The filler suspension was then added to the pulp (giving a 2:1 filler:fibre ratio) and impregnation was carried out at 300 rpm for 3 hours at 60° C. During the impregnation, samples of pulp were taken from the suspension and the degree of lumen-loading determined by washing and ashing, as in Example 1. In FIG. 6 are shown the results from four separate but similar runs and it is seen that the loading initially increases rapidly with time but then reaches a plateau value within 1 hour. After 3 hours the agitation was stopped.

Following impregnation, the pulp was washed. This was accomplished by diluting the stock with tap water to 0.5% consistency and then pumping it over a Sidehill-type screen washer to separate fibre and filler. After this the pulp, now at 5% consistency, was diluted with fresh tap water. The washing process was carried out for a total of 4 cycles. After the final washing the loaded pulp was pressed to a consistency of 20%. It was determined that this material had 0.25 g filler/g fibre within the lumens and 0.05 g filler/g fibre on external surfaces.

This example serves to show that the laboratory procedure is translatable to a pilot scale and the inference is that the process could be further scaled up to an industrial level.

Example 10

Example 1 was repeated several times but varying the filler to fibre ratio and the impregnation time to produce a series of pulps lumen-loaded to different degrees. These pulps were made into handsheets and the tensile strength properties of the sheets measured. In FIG. 7 we show a comparison of the strength properties of these handsheets with handsheets made with the same filler retained conventionally (i.e., on external fibre surfaces). These results illustrate that, an advantage of paper lumen-loaded with calcium carbonate filler over paper conventionally loaded with the same filler, is superior tensile strength at any given filler content.

Example 11

The procedure given in Example 2 was repeated but using a precipitated calcium carbonate which had been treated with 0.5% tetrasodium pyrophospate, an anionic dispersant. When impregnation is carried out at 25° C., the lumen-loading level was 0.17 g filler/g fibre but when impregnation was carried out at 75° C., the lumen-loading level dropped to 0.01 g/g. This illustrates the preferred embodiment of temperatures below 40° C. when the calcium carbonate filler is anionic, irrespective of whether it is ground or precipitated.

What is claimed is:

1. A process for production of pulp fibres, lumen-loaded with a calcium carbonate particulate filler comprising:

a) contacting pulp fibres having anionically charged lumen surfaces, with an aqueous solution of a cationic polymer in an amount of 0.01% to 1.0%, by weight of polymer based on the oven dry weight of the pulp fibres with formation of cationically charged polymer bound to the lumen surfaces, and b) contacting the resultant pulp fibres with particulate calcium carbonate filler having an anionic charge and a particle size of 0.4 to 1.5 $\mu$m, and binding the particulate calcium carbonate filler to the lumen surfaces, to produce pulp fibres lumen loaded with said calcium carbonate filler at a loading of 0.1 to 0.4 g of calcium carbonate filler per gram of fibre and a lumen content of said filler of 9 to 28%, by weight, based on the weight of lumen loaded fibres.

2. A process according to claim 1, wherein the particulate calcium carbonate filler in step b) is a ground calcium carbonate filler having an anionic charge.

3. A process according to claim 1, wherein said cationic polymer in step a) is a polymeric retention aid for filler loading of pulp in paper manufacture.

4. A process according to claim 1, wherein the pulp fibres from step b) together with filler on the external surface of the fibres is added directly to a paper furnish.

5. A process according to claim 1, wherein step b) comprises contacting said resultant pulp fibres with said particulate calcium carbonate filler for 20 to 120 minutes.

6. A process according to claim 1, wherein the lumen loading is at a filler to fibre weight ratio of 0.5:1 to 3:1.

7. Pulp fibres lumen loaded with particulate calcium carbonate filler at a loading of 0.1 to 0.4 g of said filler per gram of fibre, said filler having an ionic charge and a particle size of 0.4 to 1.5 $\mu$m and having ionically charged water soluble polymer bound to the lumen surface of the fibres as induced by the addition of an amount of 0.01% to 1.0%, by weight, of polymer based on the oven dry weight of the pulp fibres, the ionic charge on the filler being opposite to an ionic charge on the bound polymer.

8. Pulp fibres according to claim 7, wherein the lumen content of calcium carbonate filler is 9 to 28%, by weight, based on the weight of the lumen-loaded fibres.

9. Pulp fibres according to claim 8, wherein said particulate calcium carbonate filler is a ground calcium carbonate filler having an anionic charge and said polymer is cationically charged.

10. Pulp fibres according to claim 8, wherein said particulate calcium carbonate filler is a precipitated calcium carbonate filler having a cationic charge and said polymer bears carboxylate groups establishing a cationic charge, said carboxylate groups being hydrolyzed ester groups.

11. A process for the production of pulp fibres, lumen-loaded with a calcium carbonate particulate filler comprising:

i) agitating a suspension of pulp fibres with a water soluble cationic polymer at a pH below 7 to form a suspension in which the pulp fibres have the cationic polymer adsorbed on the lumen surfaces of the pulp fibres, said cationic polymer comprising a copolymer of acrylamide and acrylic acid monomers, said copolymer bearing quaternary ammonium groups attached by ester linkages to acid groups of the copolymer, said ester linkages being hydrolysable, and said quaternary ammonium groups rendering said polymer cationic, and ii) adding a cationic calcium carbonate particulate filler to the resulting suspension in step i) and agitating to impregnate the lumens of the pulp fibres with the filler under alkaline conditions and at a temperature effective to hydrolyse said ester linkages to render the adsorbed polymer anionic.

12. A process according to claim 11, further including:

iii) washing the pulp fibres from step ii) to remove filler from external surfaces of the fibres.

13. A process according to claim 11, wherein said filler is precipitated calcium carbonate filler.

14. A process according to claim 11, wherein said filler has been pretreated with cationic dispersant or cationic polymer.

15. A process according to claim 11, wherein said polymer in step i) is present in an amount of 0.01% to 1.0%, by weight, based on the oven dry weight of the pulp fibres.

16. A process according to claim 11, wherein the lumen-loaded fibres from step b have a lumen content of calcium carbonate filler of 9 to 28%, by weight, based on the weight of the lumen-loaded fibres.

17. A process according to claim 11, wherein said polymer in step i) is of a polymeric retention aid having a weight average molecular weight of $1\times10^5$ to $1\times10^7$ for filler loading of pulp in paper manufacture.

18. A process according to claim 15, wherein the lumen loading is at a filler to fibre weight ratio of 0.5:1 to 3:1; said particulate filler having a particle size of 0.4 to 1.5 $\mu$m, and fibres resulting from step ii) having a lumen loading of 0.1 to 0.4 g of the calcium carbonate filler per gram of fibre, and a lumen content of said filler of 9 to 28%, by weight, based on the weight of lumen loaded fibres.

19. A process for the production of pulp fibres, lumen loaded with a calcium carbonate particulate filler comprising:

i) agitating a suspension of pulp fibres with a water soluble cationic copolymer of acrylamide and acrylic acid monomers, said copolymer bearing quaternary ammonium groups attached by ester linkages to acid groups of the copolymer, said ester linkages being hydrolysable, and said quaternary ammonium groups rendering said polymer cationic, and ii) adding an anionic calcium carbonate particulate filler to the resulting suspension in step i) and agitating to impregnate the lumens of the pulp fibres with the filler, and wherein steps i) and ii) are carried out under conditions of temperature and pH such that said ester linkages are maintained non-hydrolysed.

20. A process according to claim 19, wherein said filler is ground calcium carbonate filler.

21. A process according to claim 19, wherein said filler is precipitated calcium carbonate filler rendered anionic by pre-treatment with an anionic dispersant or polymer.

22. A process according to claim 11, wherein said cationic polymer is selected from polyamine, polyethylenimine, poly DADMAC, polyamide and cationic starch and said filler is anionic.

23. A process according to claim 19, wherein the lumen-loaded fibres from step ii) have a lumen content of calcium carbonate filler of 9 to 28%, by weight, based on the weight of the lumen-loaded fibres.

24. A process according to claim 19, further including iii) washing the pulp fibres from step i) to remove filler from external surfaces of the fibre.

25. A process for the production of pulp fibres, lumen-loaded with a precipitated calcium carbonate particulate filler comprising:

i) agitating a suspension of pulp fibres with a water soluble cationic polymer having hydrolysable ester linkages to cationic groups of said polymer, to form a suspension in which the pulp fibres have the cationic polymer adsorbed on the lumen surfaces of the pulp fibres, and ii) adding a precipitated calcium carbonate particulate filler having a cationic charge to the resulting suspension from step i) and agitating to impregnate the lumens of the pulp fibres with the filler, under alkaline conditions and at a temperature effective to hydrolyse said ester linkages to render the adsorbed polymer anionic.

26. A process according to claim 25, wherein said particulate filler has a particle size of 0.4 to 1.5 $\mu$m; the polymer in step i) is present in an mount of 0.01% to 1.0%, by weight, based on the oven dry weight of the pulp fibres; said filler being added in step ii) at a filler to fibre weight ratio of 0.5:1 to 3:1 to produce a lumen loading in step ii) of 0.1 to 0.4 g of filler per gram of fibre, and a lumen content of said filler of 9 to 28%, by weight, based on the weight of lumen loaded fibres.

* * * * *